US007931421B2

(12) United States Patent
Rathmann et al.

(10) Patent No.: US 7,931,421 B2
(45) Date of Patent: Apr. 26, 2011

(54) GRATING

(75) Inventors: Axel Rathmann, Hude (DE); Hans-Julius Ahlmann, Budelsdorf (DE)

(73) Assignee: ACO Severin Ahlmann GmbH & Co. KG, Rensburg (DE)

( * ) Notice: Subject to any disclaimer, the term of this patent is extended or adjusted under 35 U.S.C. 154(b) by 0 days.

(21) Appl. No.: 12/447,962

(22) PCT Filed: Mar. 5, 2007

(86) PCT No.: PCT/EP2007/001874
§ 371 (c)(1),
(2), (4) Date: Aug. 26, 2009

(87) PCT Pub. No.: WO2008/052599
PCT Pub. Date: May 8, 2008

(65) Prior Publication Data

US 2010/0008719 A1 Jan. 14, 2010

(30) Foreign Application Priority Data

Oct. 30, 2006 (DE) ..... 10 2006 051 160

(51) Int. Cl.
*E02D 29/14* (2006.01)

(52) U.S. Cl. ..... 404/4; 404/2; 404/25; 52/19

(58) Field of Classification Search ..... 404/2, 4, 404/7, 25; 52/19
See application file for complete search history.

(56) References Cited

U.S. PATENT DOCUMENTS

| | | | | |
|---|---|---|---|---|
| 2,031,779 | A * | 2/1936 | Ladd | 52/668 |
| 2,396,765 | A * | 3/1946 | Walker | 239/549 |
| 5,024,550 | A | 6/1991 | Mainville | |
| D339,415 | S * | 9/1993 | Kiras | D23/397 |
| 6,612,780 | B2 * | 9/2003 | Dahowski et al. | 405/118 |
| 6,908,256 | B1 * | 6/2005 | Humphries et al. | 404/2 |

FOREIGN PATENT DOCUMENTS

| | | |
|---|---|---|
| DE | 2423305 | 11/1975 |
| DE | 85 25 580 U1 | 9/1985 |
| DE | 87 17 171 U1 | 7/1988 |
| DE | 3713971 A1 | 11/1988 |
| EP | 1 688 550 A2 | 8/2006 |

(Continued)

OTHER PUBLICATIONS

International Search Report; International application No. PCT/EP2007/001874; Completion date Jul. 11, 2007.

(Continued)

*Primary Examiner* — Raymond W Addie
(74) *Attorney, Agent, or Firm* — Pearne & Gordon LLP

(57) ABSTRACT

A cover grating for a drainage channel or a similarly hollow body which can be installed in the ground is presented, wherein the cover grating is produced in a single piece and more particularly from a sheet metal strip, comprising at least two longitudinal webs extending on the underside of the cover grating and inlet slots formed in the cover grating between these longitudinal webs and comprising transverse webs resulting from the slot forming operation and extending on the lower side of the cover grating wherein the transverse webs are provided at each of their end regions with at least one receiving projection which at least partially engages in to a respective complementarily formed receiving slot in the longitudinal web.

20 Claims, 3 Drawing Sheets

FOREIGN PATENT DOCUMENTS

| | | |
|---|---|---|
| FR | 2 190 130 | 1/1974 |

OTHER PUBLICATIONS

English Translation of the International Preliminary Report on Patentability; Dated May 14, 2009; PCT/EP2007/001874.

English translation of the first claim for foreign patent 81 17 171 U1 DE; Publication Date Jul. 21, 1988; Name of Applicant Franz Brinkmann.

English translation of the first claim for foreign patent 2 190 130 FR; Publication Date Jan. 25, 1974; Name of Applicant Resistarc Sarl.

English translation of the first claim for foreign patent 3713971 A1 DE; Publication Date Nov. 10, 1988; Name of Applicant Fritz et al.

English translation of the first claim for foreign patent 2423305 DE; Publication Date Nov. 27, 1975; Name of Applicant H. March et al.

* cited by examiner

GRATING

The present application is a national phase of International Application No. PCT/EP2007/001874 filed May 3, 2007, which claims the priority of German Patent Application No. DE 10-2006-051 160.3, filed Oct. 30, 2006.

The present invention relates to a cover grating for a drainage channel or a similar hollow body, whereby the cover grating is manufactured in a single piece from metal sheet and more particularly metal sheet strip, that can be fitted in the ground with at least two webs running along the underside of the cover grating and inlet slots formed in the cover grating between these webs and comprising transverse webs resulting from the slot formation extending along the underside of the cover grating.

Cover gratings of this kind are known from the prior art and are predominantly used to cover rain channels, floor drains, inspection shafts or similar hollow bodies that can be built into the ground. They are preferably inset on the upper edge or in a rebate formed into the upper edge of the hollow object. Cover gratings of this nature may be subjected to various levels of loading, depending on where they are fitted. Thus there are cover gratings that are designed only for loading by pedestrians and cover gratings that will also withstand heavy traffic driving across them.

As a matter of principle, however, manufacturers are interested in producing cover gratings of the type described above to be as stable and durable as possible at the lowest possible cost.

Thus DE 24 233 05 A1 discloses a cover grating with longitudinal webs and inlet slots running transversely to these. To increase the loadbearing capacity of the cover grating, the longitudinal webs are formed as loadbearing webs rolled into a closed profile. This reduces the span of the cover grating between the two loadbearing webs and makes it possible for a thinner sheet metal to be used for gratings of the same loadbearing capacity. In addition to these longitudinal webs, the design of the inlet slots creates angles that are oriented essentially normal to the longitudinal webs in the form of transverse webs. These transverse webs additionally contribute to the load distribution, especially in the transverse direction.

The sheet metal cover gratings described above, however, have the disadvantage that, despite the use of longitudinal webs, the load distribution, particularly in the transverse direction, is unsatisfactory and therefore the sheet thickness of the sheet metal to be used cannot be further reduced. In addition to this, the covet gratings described above have the disadvantage that they only have a low degree of connection stiffness, especially where the bearing faces have been damaged.

This problem is dealt with by DE 37 13 971 A1 and others. It discloses a cover grating formed from sheet metal for channels, having transverse inlet slots to accept surface water, bounded at their ends by curved parts. The webs remaining between the inlet slots that are required to absorb the loading are, to the extent that they run straight, stiffened by flanges folded downwards. The cover comprises two longitudinal webs at right angles to these transverse webs to distribute the load in the longitudinal direction. To ensure that the transverse webs are held in their end regions, i.e. by the bends, a bead on which the transverse webs are supported is provided in this area on the longitudinal webs.

U.S. Pat. No. 5,024,550 discloses a completely different development. It discloses a cover manufactured from several individual pieces. This comprises two individual longitudinal webs connected by transverse webs arranged at right angles to this. The transverse webs engage in receiving slots formed on the longitudinal webs and are secured against slipping out by spot welds.

The covers known from the prior art, however, have the disadvantage of a very complex manufacturing method and, in part, an unsatisfactory static load bearing capacity.

The problem to be solved by the present invention therefore is to provide a cover grating for a drainage channel or a similar hollow body to be built in the ground, that has a better load distribution by comparison with the prior art with at least equivalent or simplified manufacturability.

This problem is solved by a cover grating according to claim 1.

More particularly, this problem is solved by a cover grating for a drainage channel or a similar hollow body to be built into the ground, wherein the cover grating is manufactured as a single piece and more particularly a sheet metal strip and comprises two longitudinal webs running along its underside and inlet slots formed in the cover grating between these longitudinal webs, with transverse webs running along the underside of the cover grating resulting from this formation and wherein the transverse webs comprise at least one supporting section or receiving projection in the end regions which at least partially engages in a receiving section or receiving slot in the longitudinal web formed to complement it.

When the cover grating is loaded from the top side, the transverse webs resulting from the forming process and assigned to the inlet slots act as the primary load distribution elements. Since the transverse webs engage through their supporting sections formed in their end regions in the receiving sections formed to complement them in the longitudinal webs, traffic loads in particular can be distributed from the transverse webs securely into the longitudinal webs.

Furthermore, the cover grating is preferably made from one sheet and in addition to this each longitudinal web is formed integrally, and more particularly folded, with the cover grating. It is in particular this forming of the cover grating from one sheet that makes inexpensive manufacture of the cover according to the invention mentioned above possible.

The supporting sections in the transverse webs preferably have a shorter web height than do those on the longitudinal webs. In this way, there is sufficient material available in the longitudinal webs to permit vertical load distribution through the supporting sections in the transverse webs vertically downwards into the longitudinal webs.

The support section on the end region of the transverse webs is preferably a cut-out support section. Cut-out means here that only a part of the end region of the transverse web engages precisely in the support section on the longitudinal web, while another part, namely the cut-out part butts up against a side wall of the longitudinal web and does not engage in the longitudinal web through the support section or its receiving section. In this way the longitudinal web is fixed horizontally, at least in the direction of the transverse web. This means that it is also possible to give the transverse web a greater web height than the longitudinal web as a result of which the load distribution in particular is improved as in the case of the transverse web designed here as a single span beam, the component height, especially in the central region of the transverse bearer, has a decisive influence on the load dissipation characteristics.

The support section is preferably formed such that it at least in part fully penetrates the longitudinal web and projects beyond one outer side of the longitudinal web, wherein it then comprises a fastening fold or a similar fastening element on the projecting support section. In this way, the longitudinal web is also fixed outwards in a horizontal direction, i.e. in a direction facing away from the transverse web, in particular in its interaction with a cut-out support section described above. This thus results in a very stiff, yet simple to fabricate, cover grating. In additional to the horizontal stiffening, the design described above with a fastening fold or similar fastening element, or the design with the cut-out support section leads, in terms of structural strength, to the transverse web being constrained in the longitudinal web. In this way the load distribution, especially in the vertical direction, is additionally improved.

In place of the fastening fold, any other type of fastening known from the prior art may be used for the projecting support section. A suitable expansion, flanging, necking of the support section, a spot weld, etc. are some of the methods that could be proposed.

Further embodiments of the invention are described by the dependent claims.

The invention will be described more closely in below on the basis of a number of embodiment examples that are illustrated in more detail in the drawings. Where:

The same references will be used below for identical parts and parts having an identical effect, whereby the references used thus far to distinguish the same components will be used.

Figure 1:
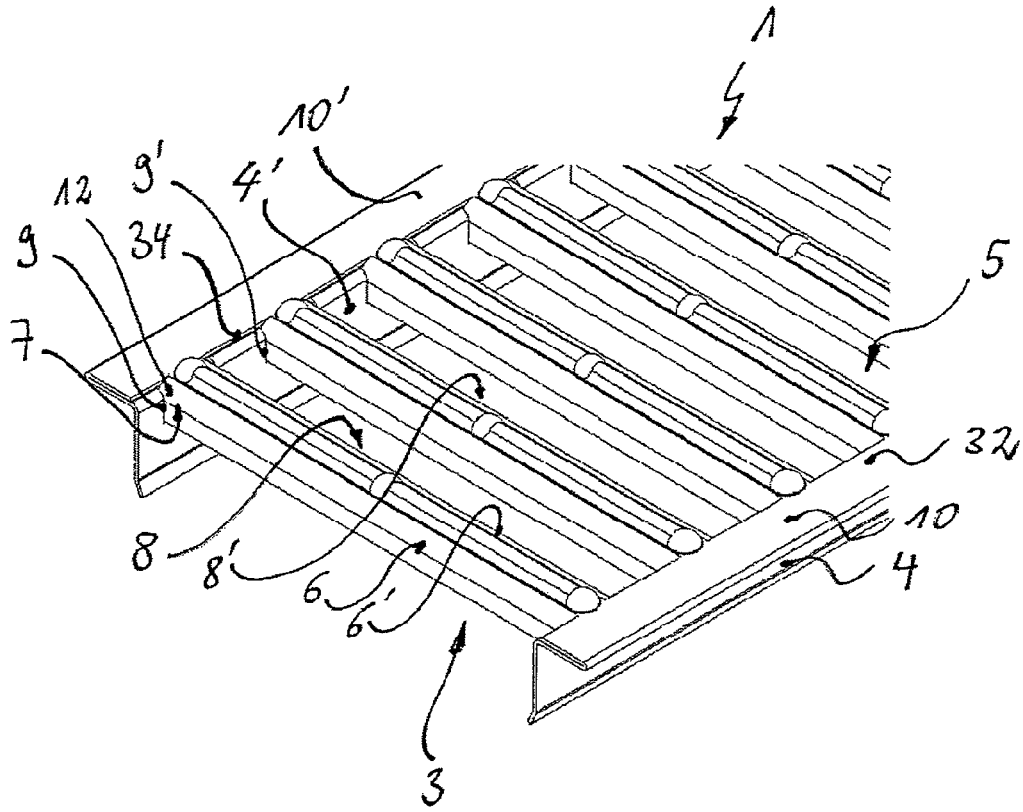
FIG. 1 is an isometric view of a first embodiment of the cover grating according to the invention seen obliquely from above.
Figure 2:
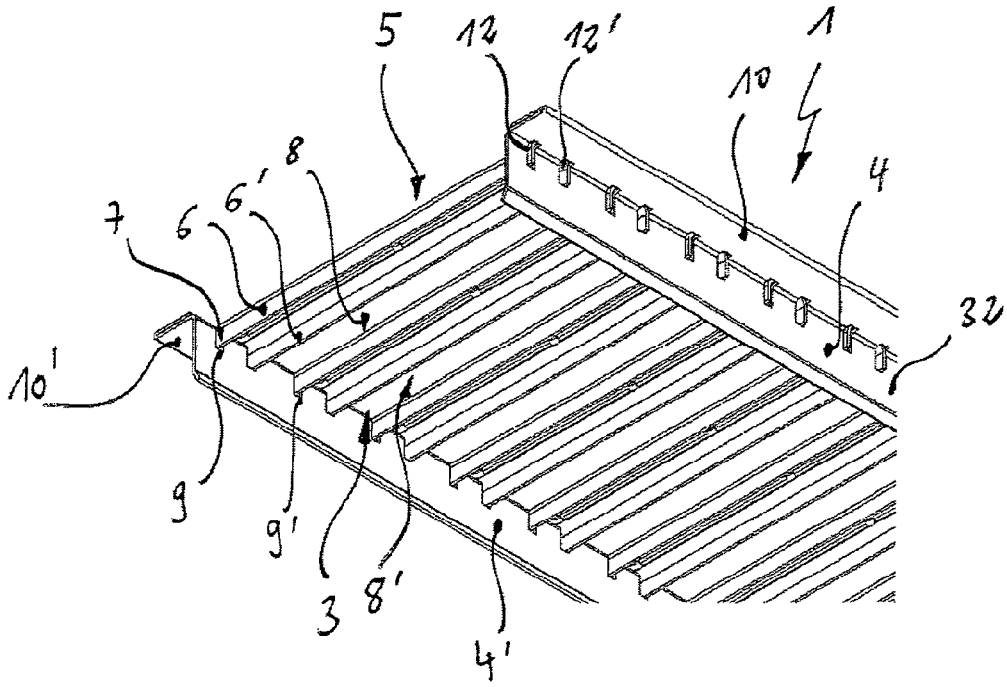
FIG. 2 is an isometric view of the embodiment from FIG. 1 seen obliquely from below.

FIGS. 1 and 2 each show an isometric view of a first design of the cover grating 1 according to the invention. The cover grating illustrated here is folded from a single sheet of metal 32 and comprises longitudinal webs 4 formed integrally with the cover grating 1. The longitudinal webs 4 have been folded multiple times from a single sheet so that bearing areas 10 have also been formed which may be used to position the cover grating 1 on a drainage channel (not illustrated).

Cover grating 1 also comprises several inlet slots 8 which may be used, in particular, for the drainage of surface water, etc. As a matter of principle, it should be mentioned here that the designation 'inlet slot' should be taken to refer to practically any inlet opening that essentially extends between the two longitudinal webs 4 of cover grating 1.

The inlet slots 8 are made by stamping and forming from the metal sheet 32 and each comprise two transverse webs 6 that each run parallel to the inlet slots 8 along the underside 3 of the cover grating 1. In this embodiment, the inlet slots have been formed by a cut 34 into the sheet 32 in the region of the transverse webs 4 and subsequent folding towards the underside 3. All methods familiar from the prior art may be applied here as long as inlet slots are created with transverse webs during the forming process.

The longitudinal webs 4 comprise receiving sections 9 in an axis with the transverse webs 6 that are formed in a complementary fashion to the support sections 12 formed at the end regions 7 of the transverse web 6 in such a way that said support sections can engage in the receiving sections 9. Load distribution through the transverse webs 6 into the longitudinal webs 4 is made safely and effectively possible in this way. Furthermore, the engagement of the support sections 12 also permits force application in the (relative to the cover grating 1) horizontal direction, from the transverse webs 6 into the longitudinal webs 4 and vice versa, which leads to a cover grating 1 with particular torsional stiffness. It is clearly visible here, in particular in conjunction with FIG. 3, that the support sections 12 can be completely accommodated in the receiving sections 9 because of the cut 34 in the production of the inlet slots 8. In particular, the support sections 12 penetrate the longitudinal webs 4 in such a way that they project beyond the outer side 18 of the longitudinal web 4. These projecting support sections 11 can now be given a fastening fold (not shown) to prevent support section 12 and receiving section 9 slipping apart, for instance.

Figure 3:
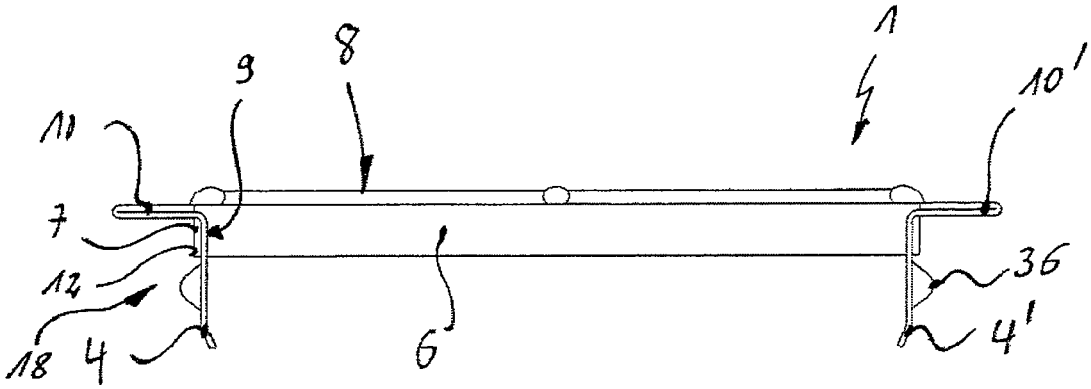
FIG. 3 is a side view of the embodiment from FIG. 1.

FIG. 3 further illustrates a locking element 36 which is also formed integrally from the sheet metal 32 and here on the longitudinal web 4 and is used to lock the cover grating 1 in a corresponding locking receptacle (not illustrated) of a drainage channel (not illustrated).

Figure 4:
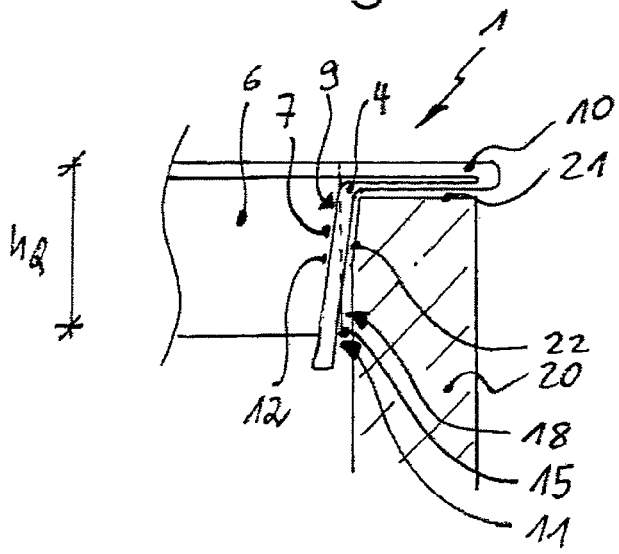
FIG. 4 is a detailed partial section of a further embodiment of the cover grating according to the invention.
Figure 5:
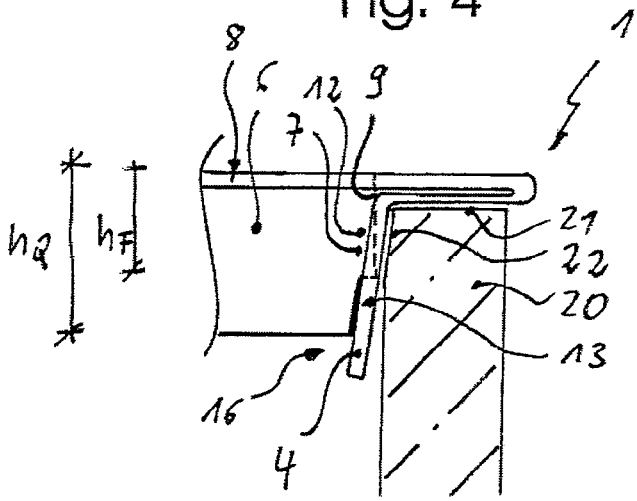
FIG. 5 is a detailed partial section of a further embodiment of the cover grating according to the invention.

FIGS. 4 and 5 show two further embodiments of the cover grating 1 according to the invention in a partial section, wherein particular attention is paid to the design of the support section 12 on the transverse web 6 and of the complementarily formed receiving section 9 on the longitudinal web 4. In the two figures, the cover grating 1 is seated by way of a bearing area 10 formed by a double fold on a drainage channel 20 or on a bearing area 21 formed on the drainage channel 20. In addition to this, each cover grating 1 comprises further transverse webs 4 which are here in contact with an essentially vertical bearing face 22 and thus permit horizontal fixing of the cover grating 1.

Thus FIG. 4 shows an embodiment in which the receiving section 9 on the longitudinal web 4 is formed correspondingly to a height $h_Q$ of the transverse web 6 so that the transverse web 6 engages in the receiving section 9 over its full web height $h_Q$. The longitudinal web 4 is arranged angled slightly to the vertical in this embodiment so that only a small part of the support section 12 projects from the outer side 18 of the longitudinal web 4. This projecting support section 11 can now, as already described for the preceding embodiment, be given a fastening fold 15, a spot weld or a similar fastening element and fastened to the longitudinal web.

In FIG. 5 on the other hand transverse web 6 has a cut-out support section 12 which engages in a complementarily formed receiving section 9 on the transverse bearer 4. The transverse web height $h_Q$ of the full transverse web 6 is, therefore, greater here than the height $h_F$ of the support section 12. The cut-out region 13 butts against an inner side 16 of the longitudinal web 4 so that, in particular, a horizontal load can be transferred from the transverse web 6 into the longitudinal web 4. It is clearly visible here that because of the cut-out support section 12 there is sufficient material available to ensure vertical load introduction from the transverse web 6 via the support section 9 into the longitudinal web 4.

FIGS. 6 to 9 show four further embodiments of the cover grating according to the invention each in a partial cross-section.

Figure 6:
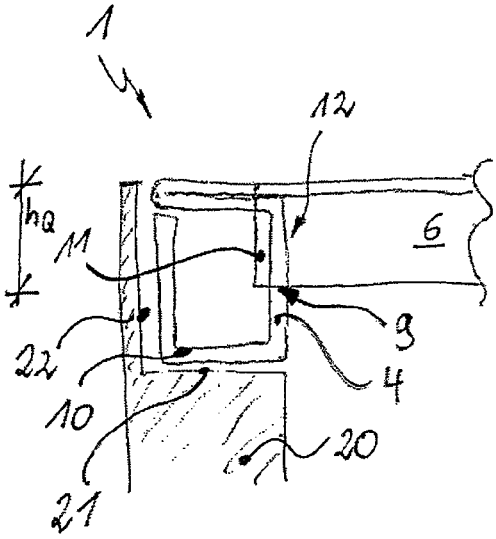
FIGS. 6 to 9 are detailed partial cross sections of four further embodiments of the cover grating according to the invention.

Thus FIG. 6 shows an embodiment in which the cover grating 1 comprises a beating area 10 modified by comparison with the preceding embodiments. The bearing area 10 is formed here by the longitudinal web 4 of the cover grating 1, whereby this longitudinal web 4 is formed into a hollow profile by multiple folds which then can be used in or on a corresponding beating face 21 in the drainage channel 20.

The drainage channel 20 here comprises a rebated bearing region 21 to which a vertical beating face 22 is integrally connected. These two bearing faces or regions 21, 22, here essentially arranged at right angles to one another, secure the position of the covet grating 1, as soon as this is placed on or in the drainage channel 20.

In this embodiment a receiving section, in which a support section 12 formed on the transverse web 6 of the cover grating 1 engages, is for its part formed on the multiply folded longitudinal web 4. The receiving section 9 or the support section 12 are formed here in such a way that the support section 12 fully penetrates a region of the transverse web 6 through the receiving section 9 so that it forms a projecting support section 11. This projecting support section 11 can then, as already described for the preceding embodiments, be locked against being removed from the receiving section 9 by means of a fastening fold (not shown or a similar fastening).

Figure 7:
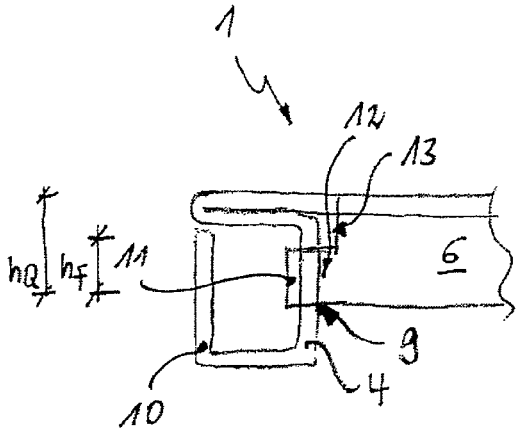

FIG. 7 shows an embodiment similar to FIG. 6 in which the longitudinal web 4 again is executed as a multiply folded flat profile which essentially forms a hollow profile that can be seated on the bearing area 21, 22 illustrated in FIG. 6. In this embodiment, however, the transverse web 6 has a cutout 13 so that this support section 12 has a lower component height $h_f$ than the transverse web 6 with its component height $h_Q$. The receiving section 9 is formed in a complementary manner to the support section 12 in this embodiment so that the support section 12 penetrates the longitudinal web 4 in the area of the receiving section 9 in such a way that it penetrates the longitudinal web in the form of a projecting support section 11. As a result of the complementary design of the receiving section 9 and the support section 12 there is a region in the area of the cutout in which the transverse web 6 butts against the longitudinal web 4 without it being possible for the transverse web 6 to shift in the direction of the vertical bearing face 22 illustrated in FIG. 6.

Figure 8:
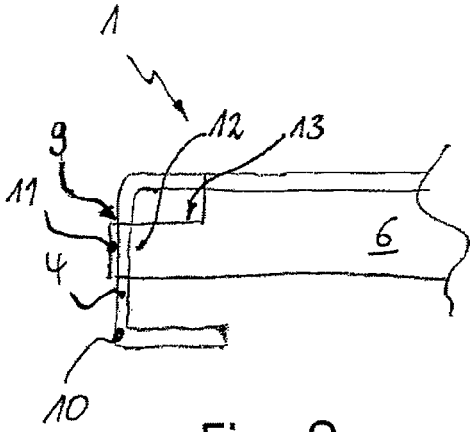
Figure 9:
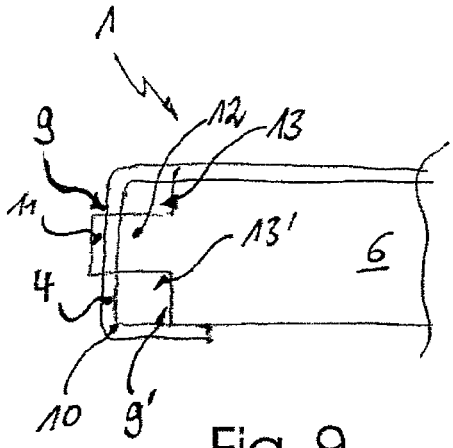

FIGS. 8 and 9 show two further embodiments of the cover grating 1 according to the invention, whereby here the longitudinal web 4 is bent into an L-shape to form the bearing region 10. Different transverse web designs with a different number of cutouts 13, 13' in the transverse web 6 and the correspondingly complementarily executed receiving sections 9 are illustrated. In these embodiments the support section 12 of the transverse web 6 penetrates the longitudinal web 4 in the region of the receiving section 9 in such a way that it forms a projecting support section 11 which then, as already mentioned a few times, can be provided by means of a fastening fold (not shown).

LIST OF REFERENCE NUMBERS

1 Cover grating
3 Underside
4 Longitudinal web
5 Upper side
6 Transverse web
7 End region
8 Inlet slot
9 Receiving section or receiving slot
10 Support area
11 Projecting support section or receiving projection
12 Support section or receiving projection
13 Cutout region
15 Fastening fold
16 Inner side
18 Outer side
20 Drainage channel
21 Bearing area
22 Vertical bearing face
32 Sheet metal strip or sheet metal
34 Cut
36 Locking element
$h_Q$ Height of transverse web
$h_F$ Height of support section

The invention claimed is:

1. Cover grating comprising a single sheet of metal with at least two longitudinal webs defining a space therebetween and running along the underside of the cover grating and inlet slots formed in the cover grating between these longitudinal webs with transverse webs running along the underside of the cover grating resulting from the forming process, wherein each transverse web entirely spans the space between the longitudinal webs characterised in that the transverse webs each comprise at their end regions a support section each at least partially engaging in one corresponding complementarily formed receiving section on the longitudinal web to provide support for the transverse webs.

2. Cover grating according to claim 1 characterised in that the support section at the end region of the transverse web is a cut out support section.

3. Cover grating according to claim 1 characterised in that the support section at least partially fully penetrates the longitudinal web and projects beyond an outer side of the longitudinal web and comprises a fastening fold or similar fastening element on the projecting support section.

4. Cover grating according to claim 1 characterised in that the longitudinal web is designed as an essentially multiply folded hollow body.

5. Cover grating according to claim 1 characterised in that the longitudinal web is formed as an essentially multiply folded hollow profile, essentially open, more particularly C-shaped, facing the transverse web.

6. Cover grating comprising a single sheet of metal with a pair longitudinal support webs running along a length of the cover grating and spaced apart to define opposite lateral sides of the cover grating, the longitudinal support webs each include a longitudinal reinforcing web extending away from a support surface of the cover grating, and each longitudinal reinforcing web includes a plurality of receiving sections;

a plurality of transverse support webs laterally extending between the pair of longitudinal support webs and spaced apart from one another along the length of the cover grating to define a longitudinal array of inlet slots, wherein each inlet slot is defined between a corresponding pair of the transverse support webs and laterally extends between the pair of longitudinal support webs; and each transverse support web includes at least one transverse reinforcing web extending away from the support surface of the cover grating and laterally extending between the pair of longitudinal support webs, and each transverse reinforcing web including opposite ends that define a pair of opposed support sections received within a corresponding pair of the receiving sections of the pair of longitudinal support webs to provide support for the corresponding transverse support web.

7. Cover grating according to claim 6, wherein the pair of longitudinal support webs are each manufactured from the single sheet of metal that is bent to define a bearing web and the longitudinal reinforcing web, wherein the longitudinal reinforcing web extends away from the bearing web.

8. Cover grating according to claim 6, wherein each transverse support web is manufactured from the single sheet of metal that is bent to define a support web and the at least one transverse reinforcing web, wherein the at least one transverse reinforcing web extends away from the support web and the support webs of the transverse support webs at least partially define the support surface of the cover grating.

9. Cover grating according to claim 8, wherein the at least one transverse reinforcing web comprises a pair of transverse reinforcing webs that are each bent down from the support web.

10. Cover grating according to claim 6, wherein the plurality of receiving sections each comprise a slot configured to receive one of the support sections from one of the transverse support webs.

11. Cover grating according to claim 6, wherein each support section of each of the transverse support webs comprises a cut out support section.

12. Cover grating according to claim 6, wherein the pair of opposed support sections each at least partially fully penetrates the corresponding longitudinal support web and projects beyond an outer side of the corresponding longitudinal support web.

13. Cover grating according to claim 12, wherein a portion of the opposed supporting sections extending beyond the outer side of the corresponding longitudinal web includes a fastening fold to prevent the support sections from slipping out of the receiving section of the corresponding longitudinal reinforcing web.

14. Cover grating according to claim 6, wherein each longitudinal support web is designed as an essentially multiply folded hollow body.

15. Cover grating according to claim 6, wherein each longitudinal support web is formed as an essentially multiply folded hollow profile with an open C-shape facing the transverse support webs.

16. Cover grating according to claim 6, wherein the longitudinal reinforcing webs corresponding to the pair of longitudinal support webs each include an inner side of a pair of spaced apart inner sides that face one another, and the opposite ends of each transverse reinforcing web each abut a corresponding one of the pair of inner sides.

17. Cover grating for a drainage channel or a similar hollow body that may be built in the ground, the cover grating comprising:

a pair longitudinal support webs running along a length of the cover grating and spaced apart to define opposite lateral sides of the cover grating, the longitudinal support webs each manufactured from a metal sheet bent to define a bearing web and a longitudinal reinforcing web extending away from a support surface of the cover grating, and each longitudinal reinforcing web includes a plurality of receiving slots spaced along the length of the cover grating;

a plurality of transverse support webs laterally extending between the pair of longitudinal support webs and spaced apart from one another along the length of the cover grating to define a longitudinal array of inlet slots, wherein each inlet slot is defined between a corresponding pair of the transverse support webs and laterally extends between the pair of longitudinal support webs; and each transverse support web is manufactured from a metal sheet bent to define a support web and a pair of transverse reinforcing webs extending away from the support surface of the cover grating, the pair of transverse reinforcing webs laterally extending between the pair of longitudinal support webs, and each transverse reinforcing web including opposite ends that define a pair of opposed support sections received within a corresponding pair of the receiving slots of the pair of longitudinal support webs to provide support for the corresponding transverse support web.

18. Cover grating according to claim 17, wherein each support section of each of the transverse webs comprises a cut out support section.

19. Cover grating according to claim 17, wherein the pair of opposed support sections each at least partially fully penetrates the corresponding longitudinal support web and projects beyond an outer side of the corresponding longitudinal support web.

20. Cover grating according to claim 17, wherein the longitudinal reinforcing webs corresponding to the pair of longitudinal support webs each include an inner side of a pair of spaced apart inner sides that face one another, and the opposite ends of each transverse reinforcing web each abut a corresponding one of the pair of inner sides.

* * * * *